US005901773A

United States Patent [19]

Grove

[11] Patent Number: 5,901,773

[45] Date of Patent: May 11, 1999

[54] DYNAMIC CLAMPING SYSTEM FOR CONTINUOUS CASTING MACHINE

[75] Inventor: John A. Grove, Franklin, Pa.

[73] Assignee: AG Industries, Inc., Coraopolis, Pa.

[21] Appl. No.: 08/828,925

[22] Filed: Mar. 28, 1997

[51] Int. Cl.[6] ..... B22D 2/00; B22D 11/16; B22D 11/00

[52] U.S. Cl. ..... 164/150.1; 164/151; 164/418

[58] Field of Search ..... 164/418, 491, 164/150.1, 151, 151.2, 154.2, 154.8, 436

[56] References Cited

U.S. PATENT DOCUMENTS

| | | | |
|---|---|---|---|
| 4,487,249 | 12/1984 | Wrhen | 164/452 |
| 5,461,933 | 10/1995 | Ives et al. | 73/862.623 |
| 5,579,824 | 12/1996 | Itoyama et al. | 164/478 |

*Primary Examiner*—Kuang Y. Lin

*Attorney, Agent, or Firm*—Knoble & Yoshida LLC

[57] ABSTRACT

A mold clamping system for clamping a first mold component to a second mold component in a continuous casting machine includes a tensioning rod that is connected to the first mold component, a support frame that is connected to the second mold component and a load cell member that has an inner portion, an outer portion and a force measuring mechanism for measuring the amount of axial force that is transmitted between the inner and outer portions. The inner portion is secured to the tensioning rod, and the outer portion is acted upon by a compression spring that is interposed between the support frame and the outer portion of the load cell member. In order to permit adjustment of the clamping force, the system also includes anti-biasing structure that is positioned to apply force to the outer portion of the load cell member for countervailing the biasing of the compression spring. This system permits an accurate measurement of the tensioning force that is applied to the mold part through the tensioning rod regardless of the amount of anti-biasing force that is being used.

10 Claims, 4 Drawing Sheets

DYNAMIC CLAMPING SYSTEM FOR CONTINUOUS CASTING MACHINE

BACKGROUND OF THE INVENTION

1. Field of the Invention

This invention relates broadly to the field of continuous casting of metals, such as steel. More specifically, this invention provides an improved system and process for monitoring the clamping force that is applied to the mold sidewalls in a continuous casting machine, and a method of controlling the continuous casting machine in response to such monitoring.

2. Description of the Prior Art

Production of metals by use of the continuous casting technique has been increasing since its large-scale introduction about thirty years ago, and now accounts for a large percentage of the volume of steel, among other metals, is introduced each year worldwide. It is well known that continuous casting machines typically include a mold that has two essentially parallel and opposed wide walls, and two essentially opposed narrow walls th at cooperate with the wide walls to define a casting passage of rectangular cross section. Molten metal is supplied continuously into a top end of the casting passage, and the mold is designed to cool the metal so that an outer skin forms before the so-formed slab or strand exits a bottom of the casting passage. The strand is further solidified by secondary cooling sprays as it travels away from the mold, until it becomes completely solidified at or near the end of the continuous casting machine. It may then be processed further into an intermediate or finished metal product, such as steel plate, sheeting or coils by traditional techniques such as rolling.

Continuous casting molds typically have two opposed pairs of sidewalls, one pair serving to clamp against the other, maintaining a fluid-tight joint therebetween. The clamping forces which are initially set by a mold assembly person may vary during the casting operation due to thermal loading. Also, the usual mechanical arrangements for setting clamping forces may be subject to variations caused by human error. Molds which have adjustable sidewalls are in some cases subject to having excess strain exerted on the clamping mechanism due to thermal loading. Also, a clamping force that is larger than necessary may be applied as a safety factor when one clamping mechanism is used for all mold sizes.

FIG. 1 depicts a conventional continuous casting mold assembly 10, in this case of the thin slab type, which includes first and second opposed mold inserts 12, 14 each defining a sidewall 16, 18, respectively. The mold inserts 12, 14 are respectively mounted on first and second support frames 20, 22. In order to clamp the sidewalls together during operation of the mold, the support frames 20, 22 are forced toward one another by at least two tensioning rods 24, each of which is kept in tension by a clamping mechanism 26. A representative clamping mechanism 26, which is identical to one disclosed in U.S. Pat. No. 4,487,249 to When, is depicted in FIG. 2. In this mechanism, one end of the tensioning rod 24 is formed as a threaded boss 28 that is positioned within a threaded recess in a first spring containment block 30. A compression spring 32 that is made of a number of Belleville spring discs is interposed between the first spring containment block 30 and a second spring containment block 34. A compressive load cell 36 is positioned between the second compression spring containment block 34 and the support frame 20. During normal casting conditions, the compression spring 32 will urge the first spring containment block 30 away from the support frame 20, thus placing the tensioning rod 24 under tension in order to clamp the mold. The tensile force in the tensioning rod 24 will be equal to the compressive force that is applied by the spring 32, which is measured by the compressive load cell 36. By monitoring the output of the load cell 36, the system or an operator could determine the clamping force that is applied to the mold, and adjust the clamping force if it was not in a predetermined range.

One way of adjusting the clamping force in a mechanism of the type shown in FIG. 2 would be to apply mechanical force (e.g. a downward force to the first spring containment block 30, as viewed in the figure) in order to counteract some of the force that is being applied by the compression spring. Unfortunately, the load cell 36 shown in FIG. 2 could not accurately measure the tensile force in the rod 24 if the clamping force was so adjusted. The mechanical force would register as additional force on the load cell 36, rendering it unable to measure the actual tensile force that is being applied to the rod 24. A need exists for a clamping mechanism and force monitoring system that is not so limited, and that more accurately reflects the actual clamping force that is applied to the mold under all conditions.

SUMMARY OF THE INVENTION

It is therefore a primary object of this invention to provide an improved system and apparatus for measuring the clamping force on the walls of continuous casting molds, and for controlling operation of the continuous casting mold in response to such monitoring, that more accurately reflects the actual clamping force that is applied to the mold under all conditions.

In order to achieve the above and other objects of the invention, a mold clamping system for clamping a first mold component to a second mold component in a continuous casting machine includes, according to a first aspect of the invention, a clamping rod that is connected to the first mold component; a support frame that is connected to the second mold component; biasing structure for biasing the clamping rod with respect to the support frame, whereby the first mold component is urged toward the second mold component; anti-biasing structure for countervailing the biasing of the biasing structure in order to adjust the force by which the first mold component is urged toward the second mold component; and force monitoring structure for monitoring the actual force within the clamping rod, irrespective of the amount of force that is applied by the anti-biasing structure, whereby the clamping forces can be dynamically determined and adjusted during operation of the mold.

According to a second aspect of the invention, a mold clamping system for clamping a first mold component to a second mold component in a continuous casting machine includes a tensioning rod that is connected to the first mold component; a support frame that is connected to the second mold component; a load cell member having an inner portion that is secured to the tensioning rod; an outer portion; and force measuring structure for measuring the amount of axial force that is transmitted between the inner and outer portions; and a compression spring interposed between the support frame and the outer portion of the load cell member, whereby a tensioning force is applied to the tensioning rod and the force measuring means measures a force that is identical to the tensioning force.

These and various other advantages and features of novelty which characterize the invention are pointed out with particularity in the claims annexed thereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
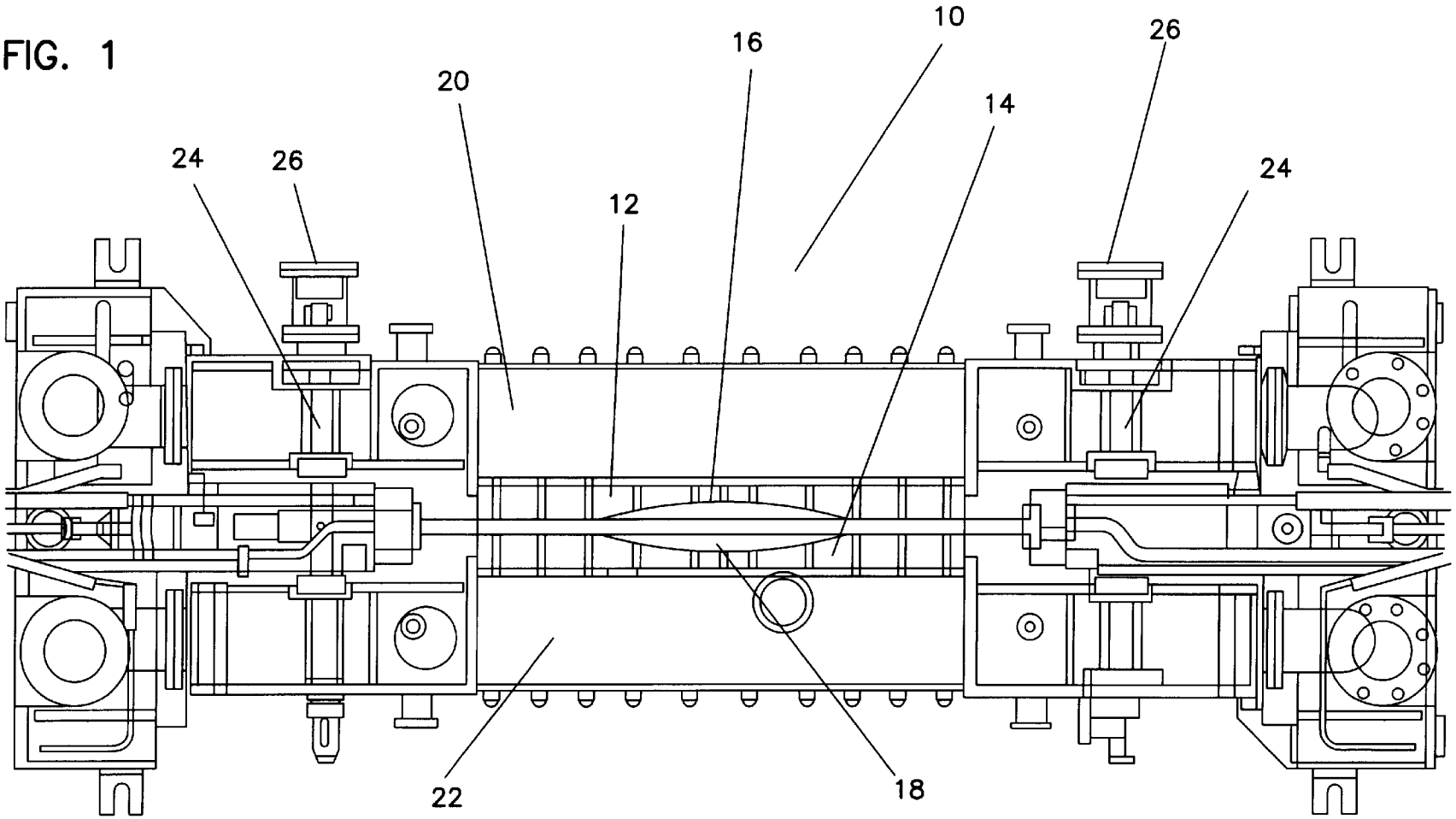
FIG. 1 is a top plan view of one type of conventional continuous casting mold, with the clamping assemblies clearly shown.
Figure 2:
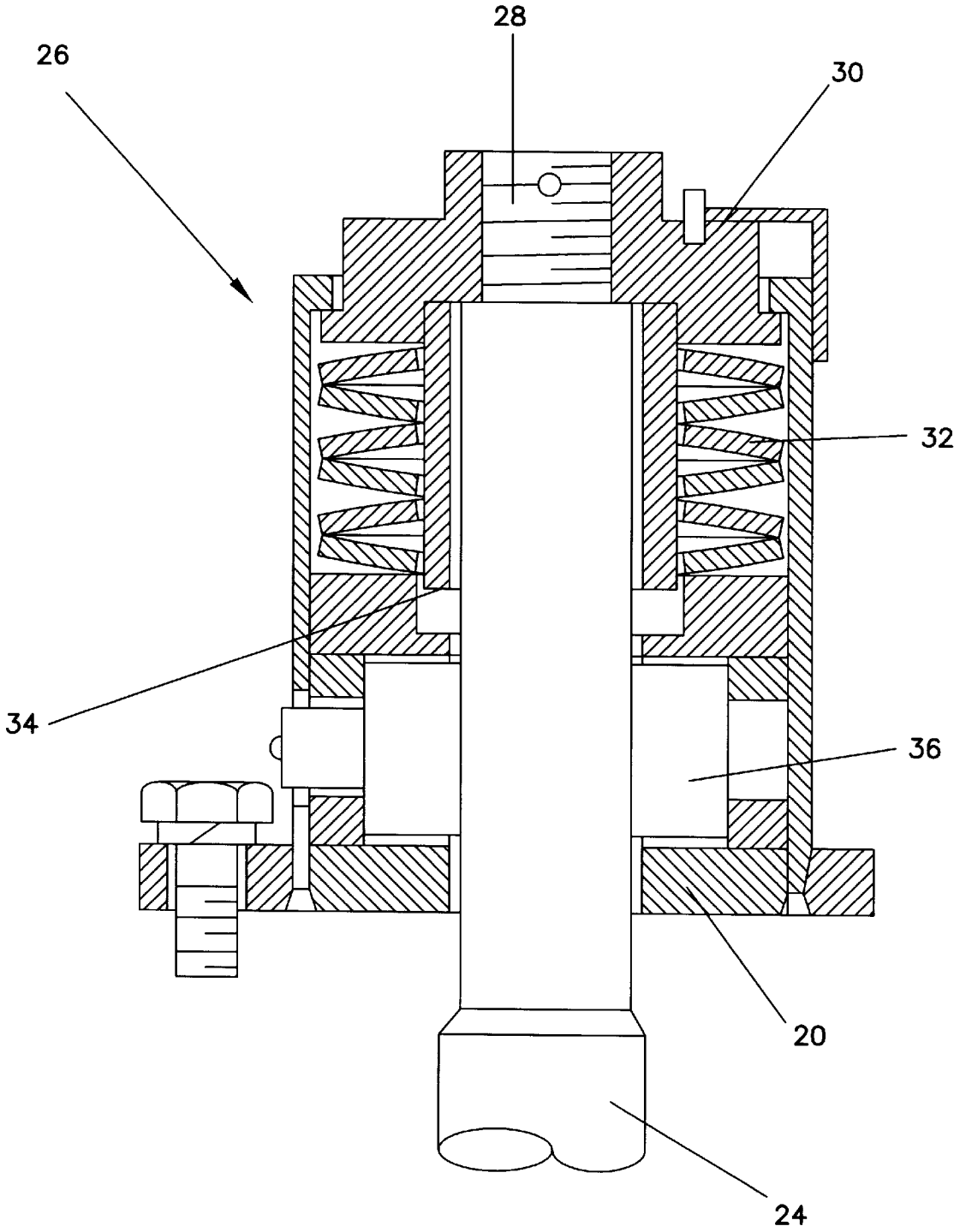
FIG. 2 is a cross-sectional view of a conventional clamping assembly for a continuous casting mold.
Figure 3:
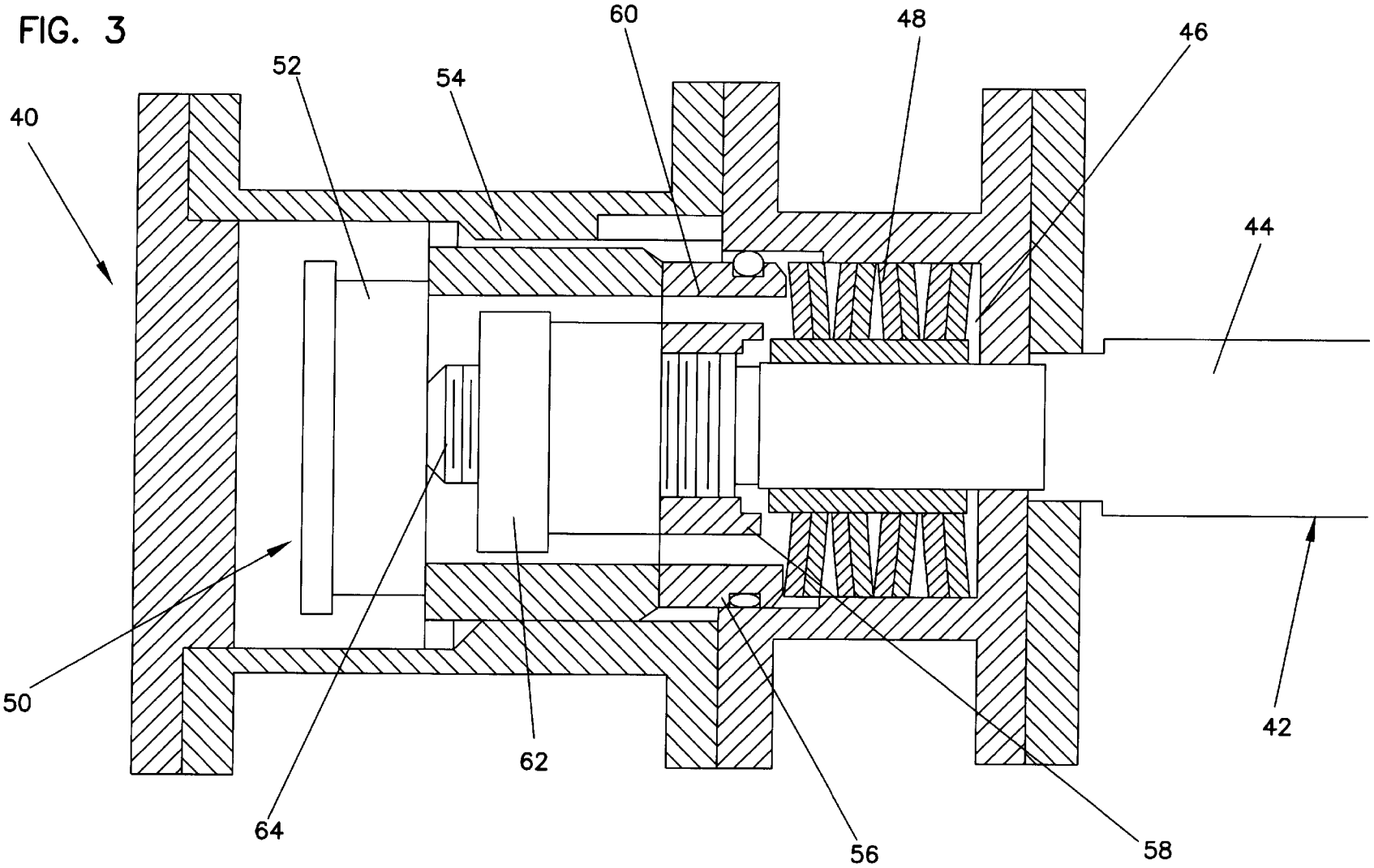
FIG. 3 is a cross-sectional view of a clamping assembly and force monitoring arrangement that is constructed according to a preferred embodiment of the invention.

Referring now to the drawings, wherein like reference numerals designate corresponding structure throughout the views, and referring in particular to FIG. 3, a mold clamping system 40 for clamping a first mold component (which in the preferred embodiment is a first mold wall assembly) to a second mold component (a second, opposing mold wall assembly) in a continuous casting machine includes, according to a preferred embodiment of the invention, a clamping rod 42 that is connected to the first mold component. Clamping rod 42 is in the preferred embodiment a tensioning rod 44 that is designed to be tensioned in order to draw the two mold components together, as is apparent when viewing FIG. 1 of the drawings. System 40 further includes a support frame 46 that is connected to the second mold component.

As may be seen in FIG. 3, a biasing mechanism that is embodied as a compression spring 48 is provided for biasing the tensioning rod 44 with respect to the support frame 46, so that the first mold component is urged toward the second mold component. The compression spring 48 is depicted as a number of Belleville disc springs, but could be of alternate construction, as would be known to those in the industry.

An anti-biasing mechanism 50, embodied as a hydraulic piston-cylinder unit 52, is further provided for countervailing the biasing of the biasing mechanism in order to adjust the force by which the first mold component is urged toward the second mold component. Alternatively, the anti-biasing mechanism could be of several alternate constructions, including but not limited to pneumatic, mechanical, or electromagnetic force application structure.

Figure 4:
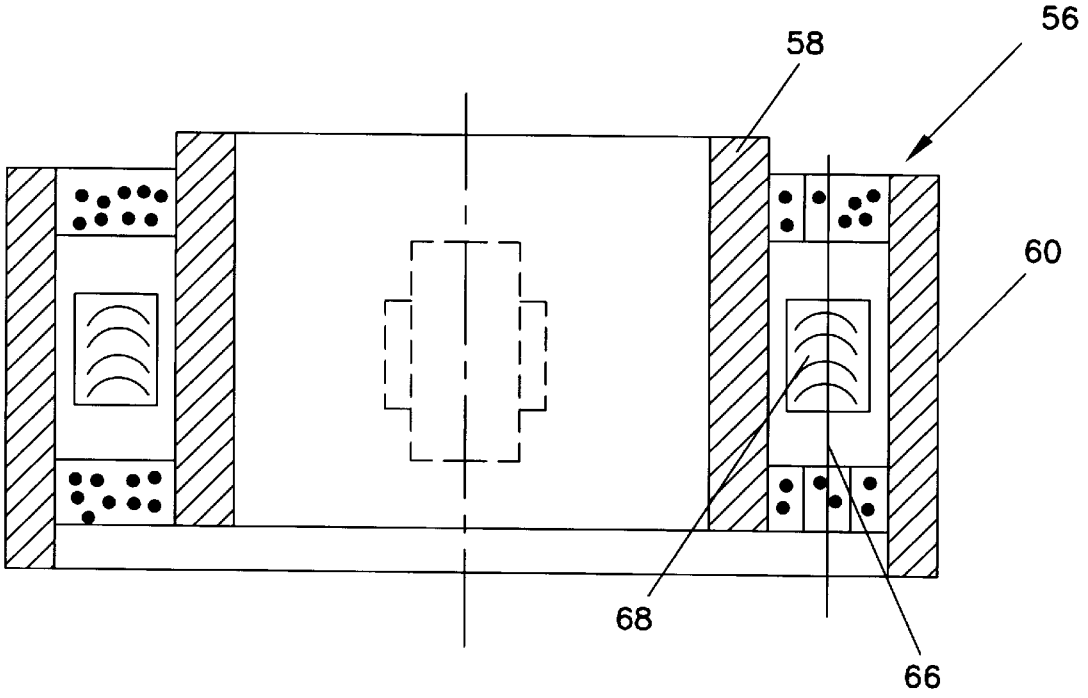
FIG. 4 is a side elevational view of a load cell that is a component of the arrangement shown in FIG. 3.

As may be seen in FIG. 3, one end of the tensioning rod 44 is formed as a threaded boss 64. A load cell 56 is provided that includes, as is best shown in FIG. 4, an inner portion 58, an outer portion 60, a connecting web 66 and a mechanism, including a strain gauge 68, for measuring the amount of axial force that is transmitted between the inner and outer portions 58, 60. The load cell 56 is of known construction, and is described in detail in U.S. Pat. No. 5,461,933 to Ives, the disclosure of which is hereby incorporated by reference as if it were fully set forth herein.

The inner portion 58 of the load cell 56 is secured to the boss end of the rod 44 by a securement nut 62. Both the compression spring 48 and the anti-biasing mechanism 50 are positioned to exert force, albeit in opposing directions, on the outer portion 60 of the load cell 56. The compression spring 48 exerts force directly on the outer portion 60, while the anti-biasing mechanism 50 exerts force on the outer portion 60 via a tubular force application block 54, as may easily be visualized by viewing FIG. 3.

The axial stress that exists between the inner and outer portions 58, 60 of the load cell 56 will always be equal to the axial tensile force within the clamping rod 42, because the inner portion 58 of the load cell 56 is the only point of connection between the clamping system 40 and the rod 42. Because the force measuring mechanism monitors the actual force within the clamping rod 42, irrespective of the amount of force that is applied by the anti-biasing mechanism 50, the clamping forces can be dynamically determined and adjusted during operation of the mold.

The system described herein, then, fulfills the goal of providing an improved system and apparatus, for measuring the clamping force on the walls of continuous casting molds, and for controlling operation of the continuous casting mold in response to such monitoring, that more accurately reflects the actual clamping force that is applied to the mold under all conditions.

The accuracy of the measurement of the clamping forces that is permitted by the present invention has particular utility for molds in which the clamping force is automatically adjusted during operation of the mold to compensate for, for example, horizontal mold oscillation in a vertical mold in order to minimize so called "oscillation marks" on the cast product. A mold system of this type is disclosed in U.S. Pat. No. 5,579,824 to Itoyama et al, the disclosure of which is hereby incorporated by reference as if it were fully set forth herein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A continuous casting mold assembly including a mold clamping system for clamping a first mold component to a second mold component in said continuous casting mold assembly, said mold clamping system, comprising:

a clamping rod that is connected to the first mold component;

a support frame that is connected to the second mold component;

biasing means for biasing the clamping rod with respect to the support frame, whereby the first mold component is urged toward the second mold component;

anti-biasing means for exerting force directly against said biasing means for countervailing the biasing of said biasing means in order to adjust the force by which the first mold component is urged toward the second mold component; and force monitoring means for monitoring the actual force within said clamping rod, irrespective of the amount of force that is applied by said anti-biasing means, whereby the clamping forces can be dynamically determined and adjusted during operation of the mold.

2. A mold assembly according to claim 1, wherein said clamping rod is a tensioning rod.

3. A mold assembly according to claim 1, wherein said biasing means comprises a compression spring that is interposed between said support frame and said clamping rod.

4. A mold assembly according to claim 3, wherein said force monitoring means comprises a load cell member having an inner portion and an outer portion, and said clamping rod is secured to said inner portion and said compression spring is positioned to apply force to said outer portion.

5. A mold assembly according to claim 4, wherein said anti-biasing means is positioned to apply force to said outer portion of said load cell member.

6. A mold assembly according to claim 5, wherein said anti-biasing means comprises a hydraulic piston-cylinder system.

7. A mold assembly according to claim 1, wherein said anti-biasing means comprises a hydraulic piston-cylinder system.

8. A continuous casting mold assembly including a mold clamping system for clamping a first mold component to a second mold component in said continuous casting mold assembly, said mold clamping system, comprising:

a tensioning rod that is connected to the first mold component;

a support frame that is connected to the second mold component;

a load cell member having an inner portion that is secured to said tensioning rod; an outer portion; and force measuring means for measuring the amount of axial force that is transmitted between said inner and outer portions; and a compression spring interposed between said support frame and said outer portion of said load cell member, whereby a tensioning force is applied to said tensioning rod and said force measuring means measures a force that is identical to the tensioning force.

9. A mold assembly according to claim 8, further comprising anti-biasing means, positioned to apply force to said outer portion of said load cell member, for countervailing the biasing of said compression spring in order to adjust the force by which the first mold component is urged toward the second mold component.

10. A mold assembly according to claim 1, wherein said anti-biasing means comprises a hydraulic piston-cylinder system.

* * * * *